US005149299A

United States Patent [19]

Sauer

[11] Patent Number: 5,149,299

[45] Date of Patent: Sep. 22, 1992

[54] ROOM-AIR INTERCEPTOR DEVICE

[76] Inventor: James F. Sauer, 1806 Susquehannock Dr., McLean, Va. 22101

[21] Appl. No.: 842,643

[22] Filed: Feb. 27, 1992

[51] Int. Cl.[5] ..... F24F 7/007

[52] U.S. Cl. ..... 454/195; 454/188; 454/192; 454/230

[58] Field of Search ..... 454/195, 188, 192, 230, 454/231, 233, 234

[56] References Cited

U.S. PATENT DOCUMENTS

| | | | |
|---|---|---|---|
| 3,086,441 | 4/1963 | London | 454/192 |
| 3,229,609 | 1/1966 | Larson et al. . | |
| 3,332,334 | 7/1967 | Melzer | 454/188 |
| 3,363,533 | 1/1968 | Tamm | 454/188 |
| 4,326,453 | 4/1982 | LaBoda et al. | 454/195 X |
| 4,522,255 | 6/1985 | Baker | 454/230 X |
| 4,534,276 | 8/1985 | Allison | 454/231 |

*Primary Examiner*—Harold Joyce
*Attorney, Agent, or Firm*—Walter F. Wessendorf, Jr.

[57] ABSTRACT

A stairwell, in a split or multi level home provides access to and air communication with lower-level, mid-level and upper-level rooms, resulting in a chimney effect of continuously drawing higher temperature and highest temperature room air from the lower-level room. Vertically directed downward axial fans of a room-air interceptor device, emplaced in the lower-level room at its ceiling and at its entrance to the stairwell, not only eliminates such chimney effect; but also intercepts and recirculates temperature-layered room air in the lower-level room, resulting from gravity circulation, to dissipate such temperature-layered room air to render the room air temperature in the lower-level room more uniform and, hence, more comfortable for human habitation and enjoyment.

4 Claims, 7 Drawing Sheets

ROOM-AIR INTERCEPTOR DEVICE

BACKGROUND OF THE INVENTION

1. Technical Field

This invention relates to a room-air interceptor device for use with the lower-level room of a split-level or multi-level home.

2. Background

A split-level or multi-level home has a stairwell which provides access to and air communication with the lower-level room and the mid-level room, or both access to and air communication with the mid-level and upper-level rooms. Without regard to whether the heating system for the home is "on" or "off", convection or gravity circulation results in the lower-level room having stratified or layered air temperatures, with the stratified air temperature in the lower-level room being the lowest at the bottom or floor and with the air temperature layering correspondingly upward with increasingly greater or higher air temperatures to the ceiling, whereat the air temperature is at its greatest or highest, thereby rendering the lower-level room uncomfortable for human habitation and enjoyment. The stairwell exacerbates such human discomfiture in the lower-level room by its "chimney-effect" in continuously drawing the highest and higher temperature air from the lower-level room. The same phenomenon exists if the heat is off in the home but the lower-level room is heated by an independent source of heat for the lower-level room, such as a space heater or a fireplace.

SUMMARY OF THE INVENTION

Accordingly, the objects of this invention are to contribute to the solutions of the discussed problems of the art by providing a room-air interceptor device, mounted for operative effect with respect to the lower level room, that continuously intercepts and re-circulates the highest and higher temperature room air in the lower-level room to decrease the stratification of such air temperatures in such lower-level room to render the air temperatures in the lower-level room more uniform and thereby comfortable for human habitation and enjoyment, and to obviate the chimney effect of the stairwell.

BRIEF DESCRIPTION OF THE DRAWINGS

These objects and other objects of the invention should be discerned and appreciated from the detailed description of the preferred embodiment of the invention, taken in conjunction with the drawing figures, wherein like reference numerals refer to similar parts throughout the several views, in which.

DETAILED DESCRIPTION OF THE PREFERRED EMBODIMENT

Figure 1:
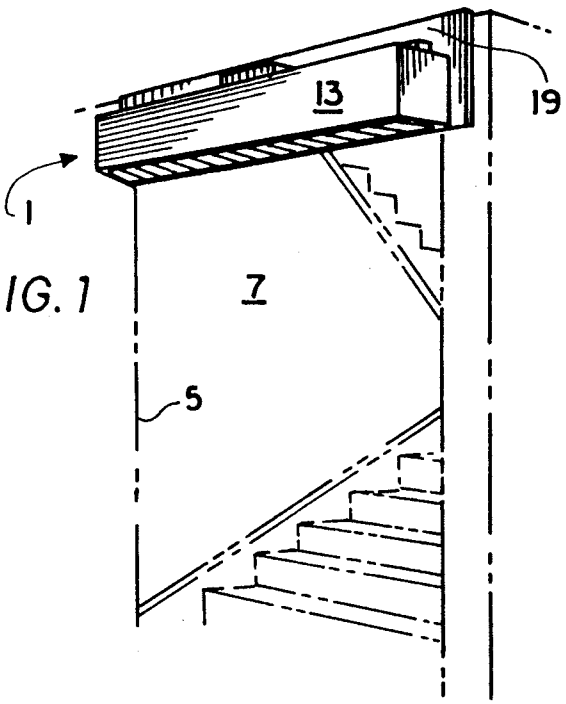
FIG. 1 is a perspective view of the mounting of the device in the lower-level room for a single side entrance to a stairwell.

In FIG. 1 of the drawings, reference numeral 1 generally refers to the invention of the room-air interceptor device shown mounted in a lower level room 3 over its single side entrance 5 to stairwell 7 which provides access to and provides air-communication from the lower level room 3 to the mid-level room 9 and upper-level room 11 of a multi-level home. The room-air interceptor device 1 has a horizontally disposed housing 13 whose upstanding wall hanger brackets 15 are affixed, via screws 17, to a mounting plate 19, disposed and appropriately fixed to abut the ceiling 21 of the lower-level room 3 and upon the single side entrance 5.

Appropriately mounted, via screws, to the housing 13, as shown, are four axial fans 23. Each of the fans 23 is 115 VAC, 14 watts, 50/60 Hz., 75 CFM, of the type manufactured by EBM Industries, Inc., 110 Hyde Road, Farmington, Conn. 06034-4009, Model No. W2S110 and shown, described and specified on page 14 of its company Catalog T9/3; or of a similar type of other manufacturing companies. The axial fans 23, as mounted, correspondingly are directed vertically downward. The housing 13 for the fans 23 is appropriately mounted such that a clearance of approximately 2" is afforded between the ceiling 21 of the lower-level room 3 and the intakes for the axial fans 23. 120 VAC electrical power operates the fan motors, wired from a conventional power source to and through a conventional on/off switch 25, fan speed control 27 (of the type such as is manufactured by Power Controls Corp., Model FS-301, 120 VAC, 3A., 60 Hz., single pole), and a pre-settable monitoring thermostat (of the type such as is manufactured by Honeywell, Model T6051A 1016, 120/240 VAC control, range 50°–80° F., 1° F. differential, single pole double throw switching).

Figure 2:
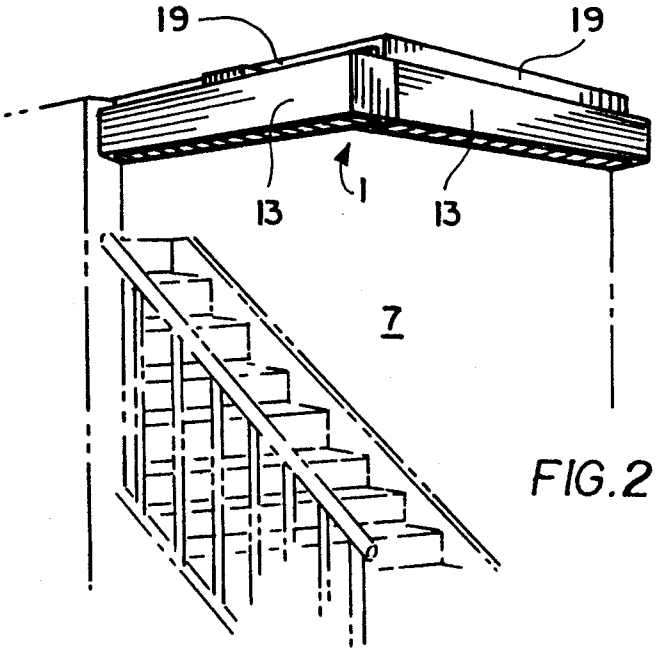
FIG. 2 is a perspective view of the mounting of two of the devices in the lower-level room for two open sides to a stairwell.
Figure 3:
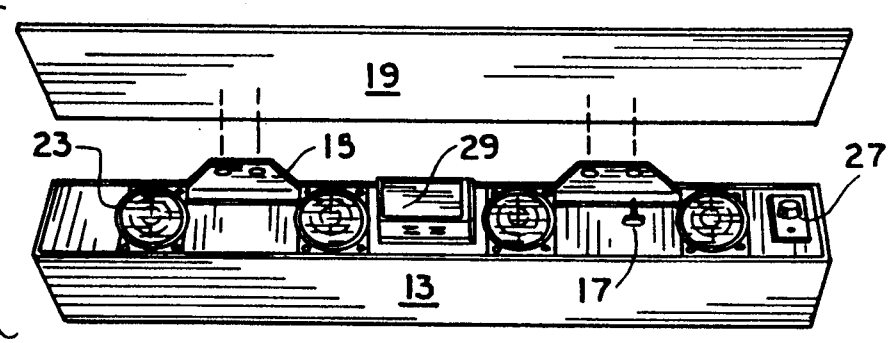
FIG. 3 is a perspective view of the device, preparatory to its being mounted.
Figure 4:
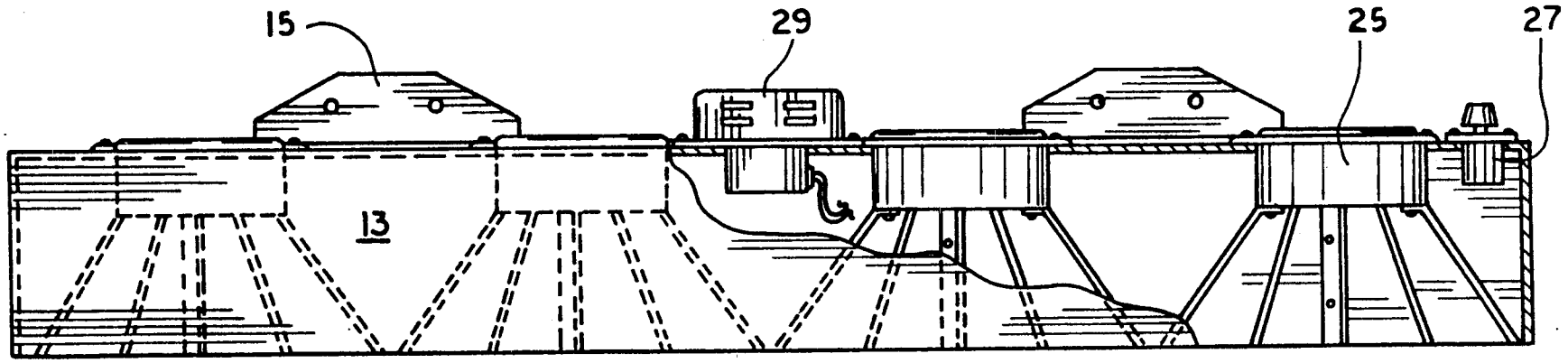
FIG. 4 is a front elevational view, partly broken away, of the device.
Figure 5:
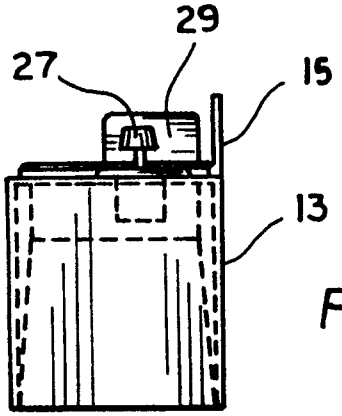
FIG. 5 is a right-side elevational view of the device, shown in FIG. 4.

FIG. 2 depicts two open sides to the stairwell 7, with two horizontally disposed housings 13 with their axial fans 23, in right-angle orientation, fixedly mounted on their respective mounting plates 19, and which provide the same functional attributes that the single housing 13 provides in connection with the single side entrance 5 to the stairwell 7.

A conventional warm-air heating system is employed and in FIGS. 6–9 are shown a wall register 31, a ceiling register 33 and a cold-air return ceiling face 35 in the lower-level room 3; a wall register 37 for the mid-level room 9; and, a wall register 39 for the upper-level room 11, and a cold-air-return wall face 41 for the mid-level room 9 and the upper-level room 11.

Figure 6:
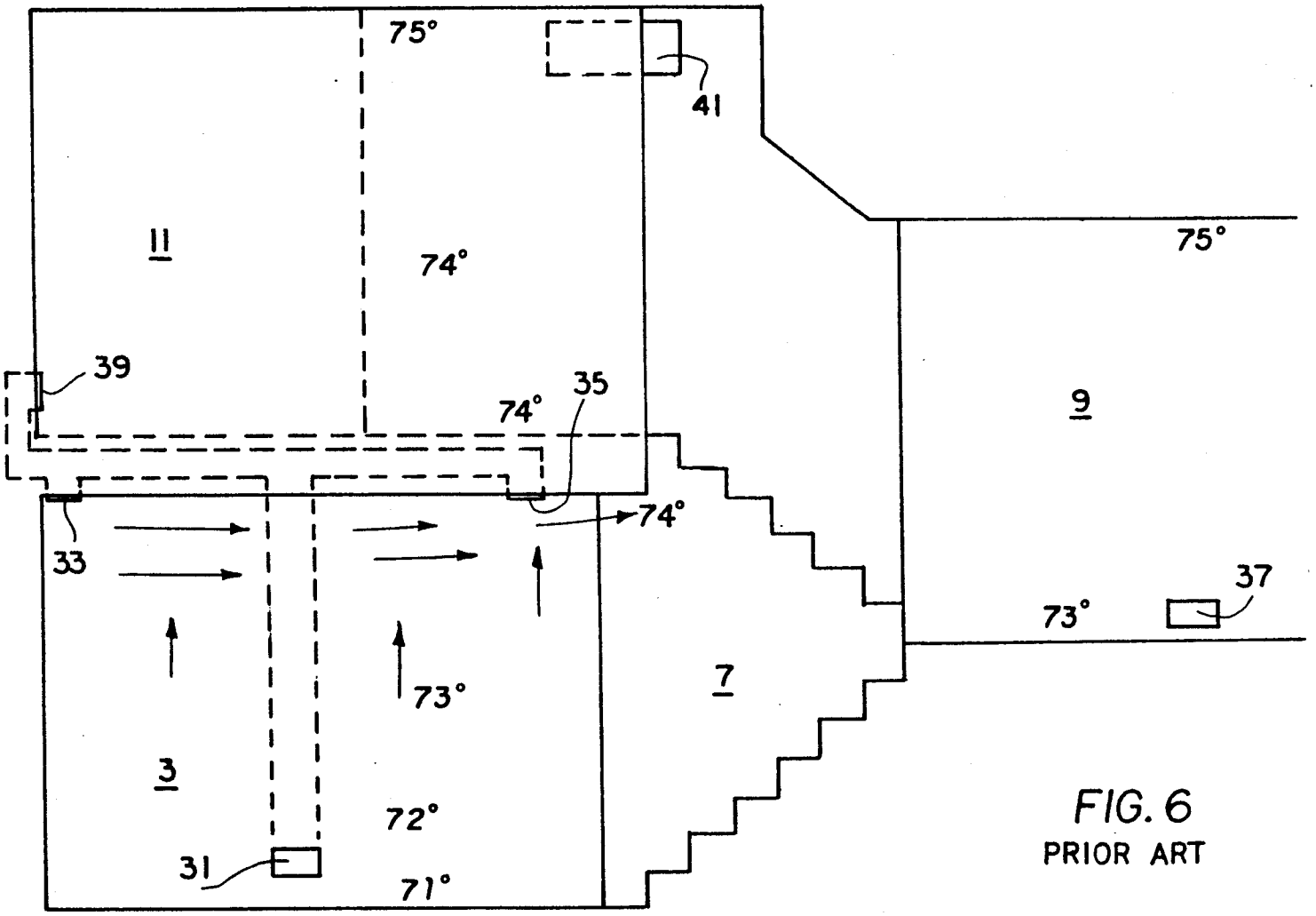
FIG. 6 PRIOR ART
FIG. 6 is a view representing a stairwell providing access to and communication with the lower-level, mid-level and upper-level rooms of a home, with its warm-air heating system off, and showing stratified or layered room air temperatures that result from gravity circulation, with the heating system being off for several hours, and coupled with the chimney effect of the stairwell upon the lower-level room.

FIG. 6 represents the conditions that prevail when the thermostat, controlling the warm-air heating system was set at 74° F., had been attained and shut off the warm-air heating system. As a result of convection or gravity circulation, the stratification of the air temperatures in the lower-level room 3 ranges from 71°–74° F.,coupled with the chimney effect of the stairwell 7 in continuously drawing the 74° F. highest temperature air and 73° F. higher temperature air from the lower-level room 3 and up the stairwell 7; the stratification of the air temperatures in the mid-level room 9 ranging from 73°–75° F.; and the stratification of the air temperatures in the upper-level room 11 ranging between 74°–75° F.

Figure 7:
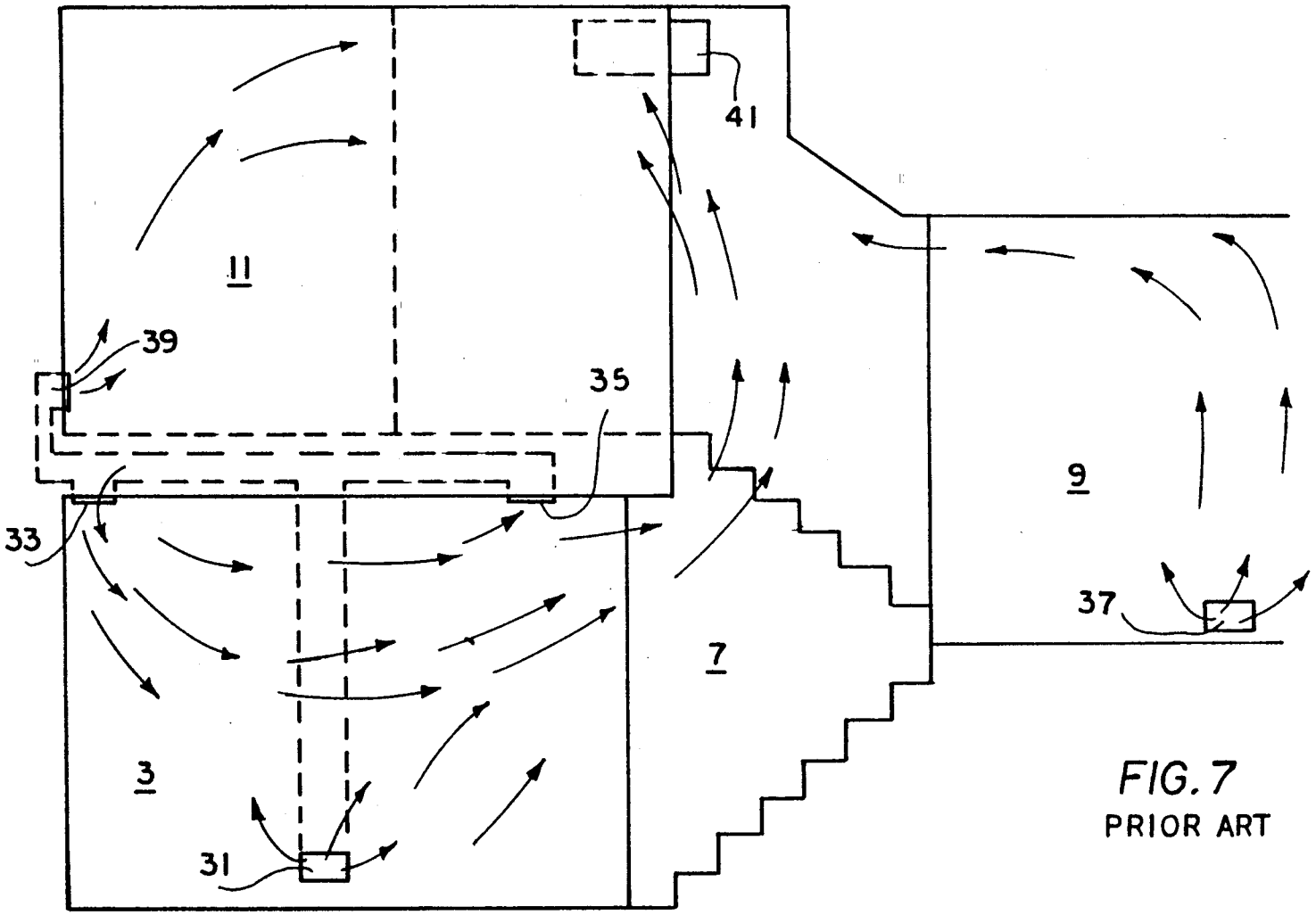
FIG. 7 PRIOR ART
FIG. 7 is the same representation, shown in FIG. 6, with the directional flow arrows showing the air movements of the heat after the heating system had turned on, and coupled with the chimney effect of the stairwell upon the lower-level room.

In FIG. 7, the conditions that prevail in the lower-level room 3, mid-level room 9 and upper-level room 11 are demonstrated by the directional flow arrows for the movements of air, after the warm-air heating system has turned on, and coupled with the continuous chimney effect of the stairwell 7 upon the lower-level room 3.

Figure 8:
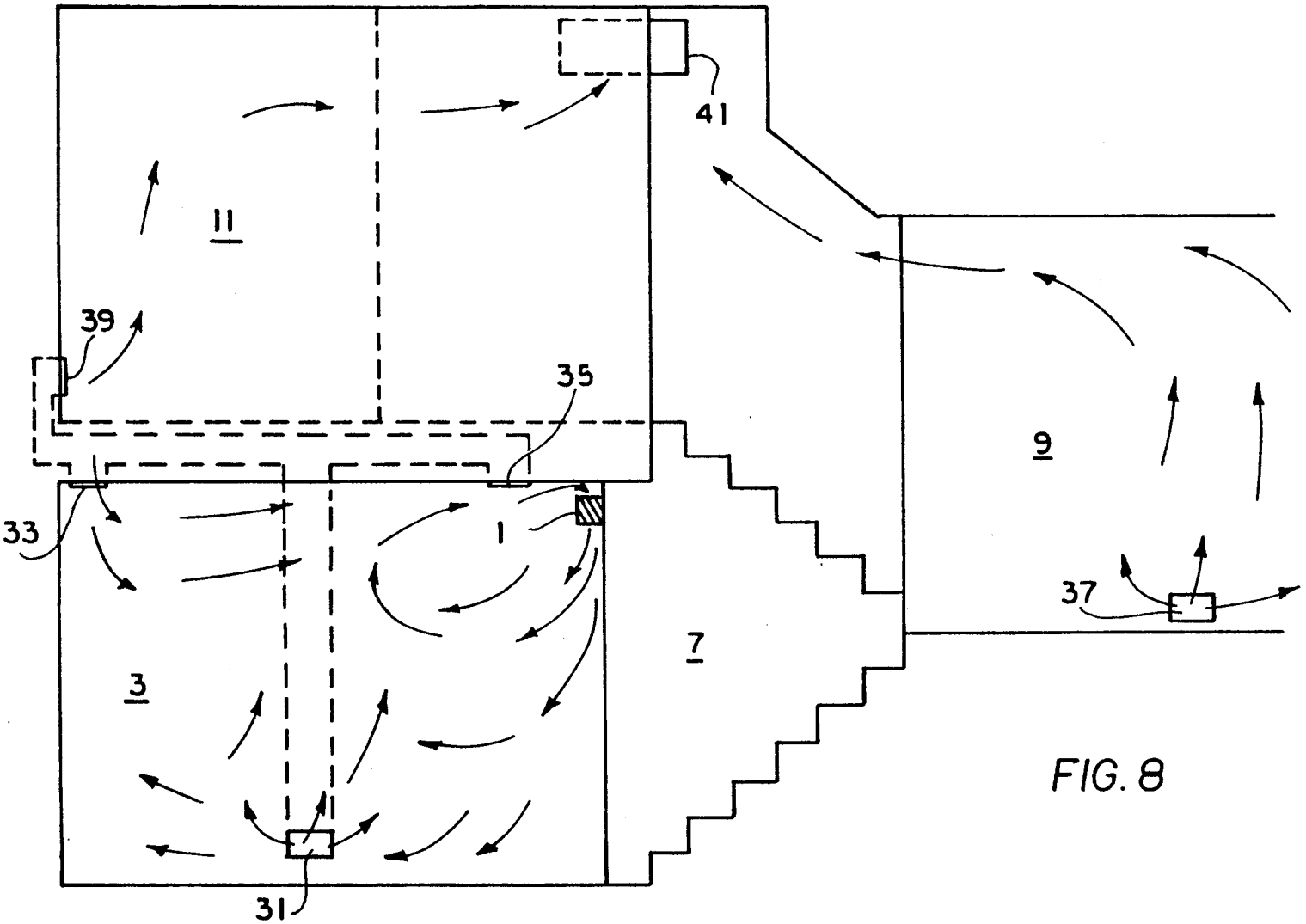
FIG. 8 is the same representation, shown in FIG. 7, with the directional flow arrows showing the effect of the operation of the device in intercepting and re-circulating the highest and higher temperature room air in the lower-level room, and obviating the chimney effect from the stairwell upon the lower-level room.

FIG. 8 shows the dramatic effects upon the air movements, in comparison to FIG. 7, from the operation of the radial fans 23 of the device 1, in the fans' intercepting and recirculating the highest and higher temperature room air in the lower-level room 3 to render the air temperatures more uniform and thereby comfortable for human habitation and enjoyment, and by the fans' eliminating the stairwell's chimney effect upon the lower-level room 3; and FIG. 8 further demonstrates that, even though the warm-air heating system is operating, the intercepting and recirculating functional attributes of the axial fans 23, render the air temperatures more uniform.

Figure 9:
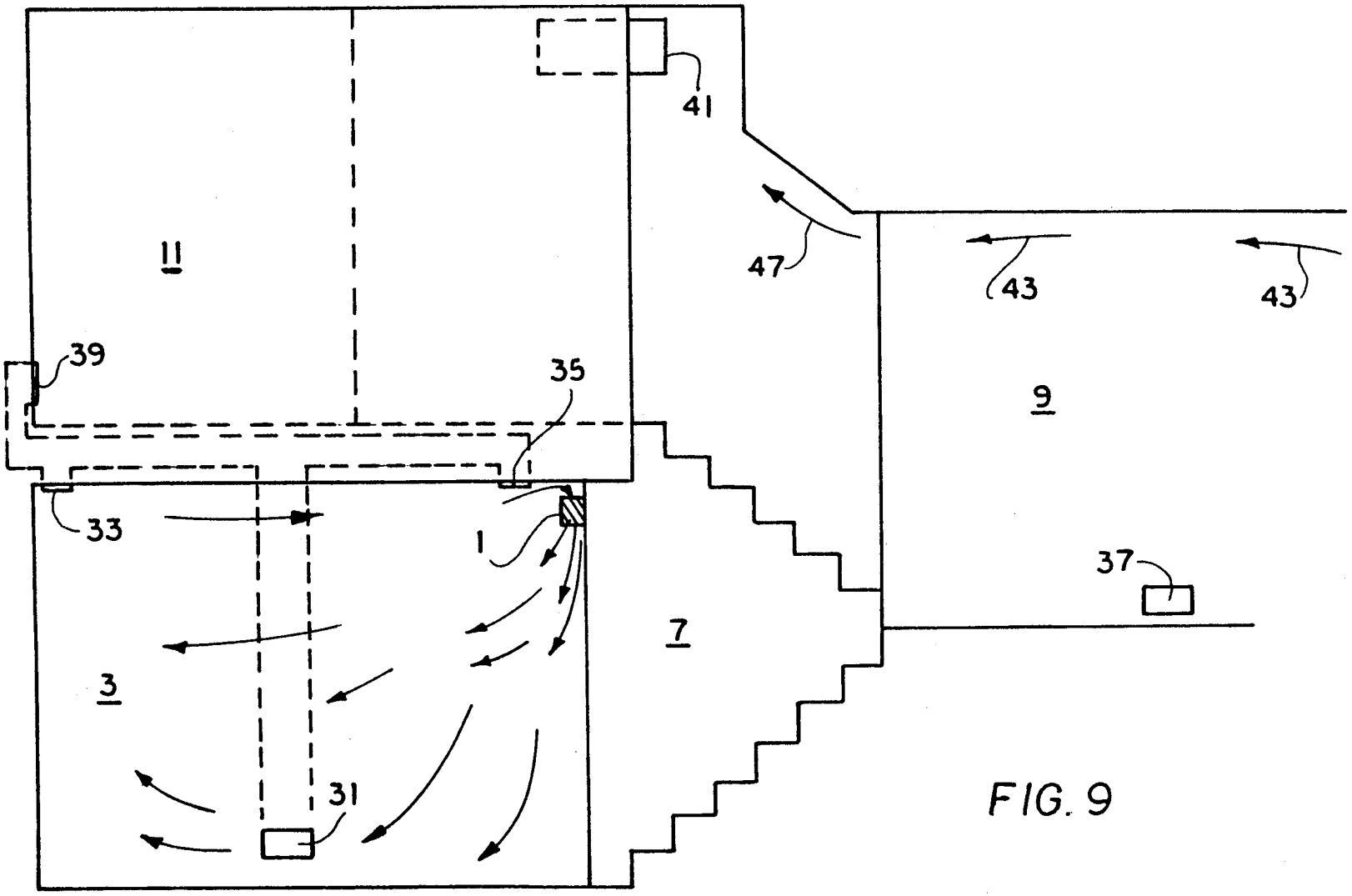
FIG. 9 is the same representation, shown in FIG. 8, with the directional flow arrows showing the latent effect from the continued operation of the device in intercepting and re-circulating the highest and higher temperature room air in the lower-level room after the home heating system has been off for 10–15 minutes, and with the device still obviating the chimney effect from the stairwell upon the lower level room.
Figure 10:
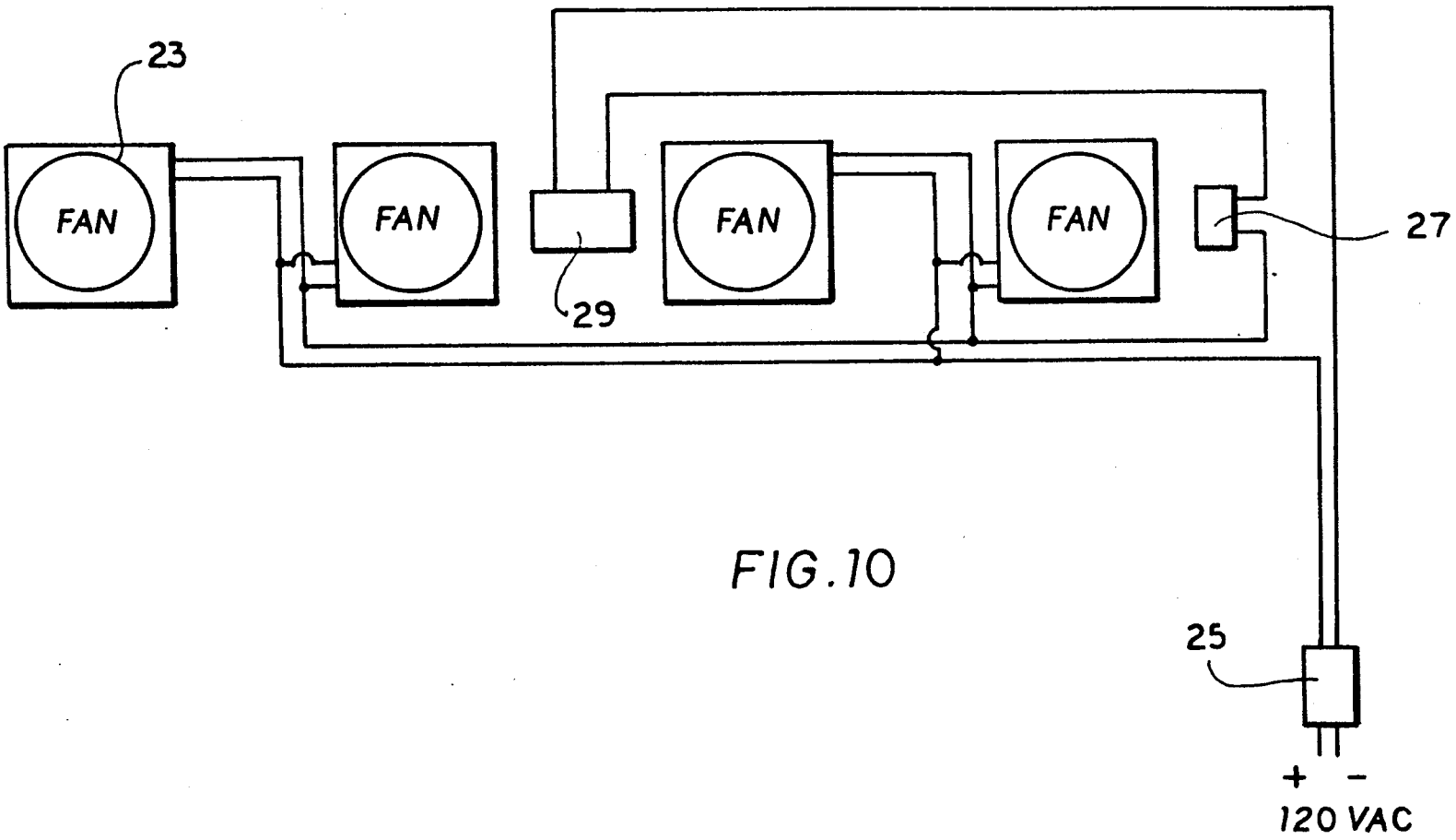
FIG. 10 is an electrical block diagram for the components of the device.

FIG. 9 shows the latent effect of the continued operation of the device 1 after the warm-air heating system has been off for 10–15 minutes; and the three directional flow arrows 43 show the minor residual effects of air flow near the ceiling of the mid-level room 9 to the wall face 41 as a result of the chimney effect that the stairwell 7 imposes upon the mid-level room 9.

The thermostat 29 allows a temperature to be set to monitor the ceiling room temperature of the lower-level room 3 in the immediate vicinity of the housing 13 and to complete the 120 VAC circuit to the fans 23 when such temperature has been reached. The fan speed control 27 allows the speed of the fans 23 to be adjusted for maximum or desired effectiveness of the device 1.

I claim:

1. A room-air interceptor device means in combination with a first room, at least a second room and a stairwell, with said stairwell providing access to and providing air communication with said first room and said second room, with said first room having a floor and ceiling and said second room having a floor and ceiling, with said floor and ceiling of said first room being spatially below said floor and ceiling of said second room, respectively, and with said first room and said stairwell having a common entrance, said room-air interceptor device means being mounted in proximal relationship to said ceiling of said first room and before said first room's entrance to said stairwell, said interceptor device means operating to dissipate the effects of convection or gravity circulation in said first room, resulting in and ranging from the lowest air temperature being at the floor of said room to the higher temperature air being in proximal relationship to the ceiling of the first room and the highest temperature air being at the ceiling of the first room, by intercepting and recirculating such higher and highest temperature room air, in the first room, within the first room to render the room air temperature in the first room more uniform and, hence, more comfortable for human habitation and enjoyment, and by said interceptor device means further functioning to eliminate the stairwell's chimney effect in continuously drawing such higher and highest temperature room air from the first room.

2. A room-air interceptor device means in accordance with claim 1, wherein said interceptor device means has a housing and wherein said housing mounts electrically powered axial fans directed vertically downward.

3. A room air interceptor device means in accordance with claim 2, wherein is further provided a power source, wired via circuitry, to electrically power said fans and wherein said circuitry has inline a temperature pre-settable thermostat to monitor the ceiling room air temperature in the immediate vicinity of the housing and to complete the circuit to the fans when such ceiling room air temperature has attained the pre-set temperature of the thermostat.

4. A room-air interceptor device means in accordance with claim 3, wherein said circuitry has inline a fan speed control for adjusting the speed of operation of the fans for either maximum effectiveness or for a desired effectiveness of the fans.

* * * * *